United States Patent [19]

McAliley et al.

[11] Patent Number: 4,781,223

[45] Date of Patent: Nov. 1, 1988

[54] WEAVING PROCESS UTILIZING MULTIFILAMENTARY CARBONACEOUS YARN BUNDLES

[75] Inventors: J. Eugene McAliley, Rock Hill, S.C.; Gene P. Daumit, Charlotte; Fredrick A. Ethridge, Waxhaw, both of N.C.; James R. Crozier, Jr., Rock Hill, S.C.

[73] Assignee: BASF Aktiengesellschaft, Ludwigshafen, Fed. Rep. of Germany

[21] Appl. No.: 66,551

[22] Filed: Jun. 26, 1987

Related U.S. Application Data

[60] Division of Ser. No. 748,781, Jun. 27, 1985, Pat. No. 4,714,642, which is a continuation-in-part of Ser. No. 647,739, Sep. 6, 1984, abandoned, which is a continuation-in-part of Ser. No. 527,728, Aug. 30, 1983, Pat. No. 4,534,919.

[51] Int. Cl.[4] ..... D03D 23/00

[52] U.S. Cl. ..... 139/420 R; 428/114; 264/29.2

[58] Field of Search ..... 139/420 R, 420 A; 428/108, 109, 113, 114, 232, 297, 260, 290, 195, 196, 198, 227, 257, 299, 408; 264/29.2, 29.6, 29.7, 108; 423/447.8, 447.6, 447.4

[56] References Cited

U.S. PATENT DOCUMENTS

| | | | |
|---|---|---|---|
| 2,379,824 | 7/1945 | Mummery | 34/12 |
| 2,783,609 | 3/1957 | Breen | 57/350 |
| 2,799,915 | 7/1957 | Barnett et al. | 28/166 |
| 2,985,995 | 5/1961 | Bunting et al. | 57/350 |
| 3,017,737 | 1/1962 | Breen | 57/350 |
| 3,226,773 | 1/1966 | Paliyenko | 19/66 |
| 3,237,269 | 3/1966 | Hawkins | 28/100 |
| 3,262,179 | 7/1966 | Sparling | 28/100 |
| 3,279,164 | 10/1966 | Breen et al. | 57/350 |
| 3,376,609 | 4/1968 | Kalwaites | 19/66 |
| 3,508,874 | 4/1970 | Rulison | 423/447.4 |
| 3,539,295 | 11/1970 | Ram | 423/447.6 |
| 3,656,904 | 4/1972 | Ram | 423/447.7 |
| 3,704,485 | 12/1972 | Hall | 19/65 |
| 3,723,157 | 3/1973 | Druin | 423/447.8 |
| 3,723,605 | 3/1973 | Ram | 423/447.4 |
| 3,727,274 | 4/1973 | White | 28/100 |
| 3,760,458 | 9/1973 | Pitt | 19/66 |
| 3,769,390 | 10/1973 | Weisbeck et al. | 423/447.4 |
| 3,775,520 | 11/1973 | Ram et al. | 423/447.8 |

(List continued on next page.)

FOREIGN PATENT DOCUMENTS

| | | | |
|---|---|---|---|
| 2639409 | 3/1977 | Fed. Rep. of Germany | 264/29.2 |
| 0004825 | 3/1981 | Japan | 264/29.2 |
| 0036216 | 8/1981 | Japan | 264/29.2 |

*Primary Examiner*—Henry S. Jaudon

*Attorney, Agent, or Firm*—Burns, Doane, Swecker & Mathis

[57] ABSTRACT

An improved multifilamentary tow of carbon fibers is provided which possesses a novel physical configuration that better enables it to undergo impregnation with a matrix-forming resin to form quality composite articles. The individual filaments of the tow are randomly decollimated and commingled with numerous filament cross-over points throughout the length of the multifilamentary tow in order to create a multitude of interstices between adjacent filaments which are well adapted to receive and retain a matrix-forming resin as evidenced by the ability of the filaments when subjected to the flaring test described herein to resist lateral expansion to a width that is as much as three times the original width. The tow commonly comprises approximately 1,000 to 50,000 filaments. Also, the filaments of the tow are substantially continuous and contain at least 70 percent carbon by weight (preferably at least 90 percent carbon by weight). In a preferred embodiment wherein the resistance to lateral expansion is the greatest, the multifilamentary bundles have been found to be capable of being readily woven with no significant productivity loss to form a quality reinforcing fabric while free of a protective size, such as that which has heretofore been required while weaving carbonaceous multifilamentary yarn bundles of the prior art.

22 Claims, 5 Drawing Sheets

U.S. PATENT DOCUMENTS

| | | | |
|---|---|---|---|
| 3,795,944 | 3/1974 | Daniels | 19/65 |
| 3,798,095 | 3/1974 | Hall | 156/73 |
| 3,844,822 | 10/1974 | Boss et al. | 118/59 |
| 3,873,389 | 3/1975 | Daniels | 156/181 |
| 3,900,556 | 8/1975 | Clarke | 423/447.7 |
| 3,914,393 | 10/1975 | Ram et al. | 423/447.7 |
| 3,925,524 | 12/1975 | Kimmel et al. | 423/447.4 |
| 3,954,947 | 5/1976 | Didchenko et al. | 423/447.4 |
| 3,954,950 | 5/1976 | Ram et al. | 423/447.6 |
| 4,020,273 | 4/1977 | Dix et al. | 373/110 |
| 4,112,059 | 9/1978 | DiEdwardo et al. | 264/29.2 |
| 4,186,179 | 1/1980 | Katsuki et al. | 264/29.2 |
| 4,220,686 | 9/1980 | Brook | 428/372 |
| 4,295,844 | 10/1981 | Warner | 423/447.4 |
| 4,316,925 | 2/1982 | Delmonte | 428/245 |
| 4,347,279 | 8/1982 | Saji et al. | 264/29.7 |
| 4,370,141 | 1/1983 | Lee et al. | 264/29.2 |
| 4,452,860 | 6/1984 | Obama et al. | 264/29.2 |
| 4,659,624 | 4/1987 | Yeager et al. | 264/29.2 |

WEAVING PROCESS UTILIZING MULTIFILAMENTARY CARBONACEOUS YARN BUNDLES

CROSS-REFERENCE TO RELATED APPLICATIONS

This is a division of U.S. Ser. No. 748,781, filed June 27, 1985 (now U.S. Pat. No. 4,714,642), which is a continuation-in-part of U.S. Ser. No. 647,739, Sept. 6, 1984 (now abandoned), which is a continuation-in-part of U.S. Ser. No. 527,728, filed Aug. 30, 1983 (now U.S. Pat. No. 4,534,919).

BACKGROUND OF THE INVENTION

In the search for high performance materials, considerable interest has been focused upon carbon fibers. The terms "carbon" fibers or "carbonaceous" fibers are used herein in the generic sense and include graphite fibers as well as amorphous carbon fibers. Graphite fibers are defined herein as fibers which consist essentially of carbon and have a predominant x-ray diffraction pattern characteristic of graphite. Amorphous carbon fibers, on the other hand, are defined as fibers in which the bulk of the fiber weight can be attributed to carbon and which exhibit an essentially amorphous x-ray diffraction pattern. Graphite fibers generally have a higher Young's modulus than do amorphous carbon fibers and in addition are more highly electrically and thermally conductive. It will be understood, however, that all carbon fibers, including amorphous carbon fibers, tend to include at least some crystalline graphite.

Industrial high performance materials of the future are projected to make substantial utilization of fiber reinforced composites, and carbon fibers theoretically have among the best properties of any fiber for use as high strength reinforcement. Among these desirable properties are corrosion and high temperature resistance, low density, high tensile strength and high modulus. During such service, the carbon fibers commonly are positioned within a solid continuous phase of a resinous matrix (e.g. a solid cured epoxy resin, polyimide resin, a high performance thermoplastic resin, etc.). Uses for carbon fiber reinforced composites include aerospace structural components, rocket motor casings, deep-submergence vessels, ablative materials for heat shields on re-entry vehicles, strong lightweight sports equipment, etc.

As is well known in the art, numerous processes have heretofore been proposed for the thermal conversion of organic polymeric fibrous materials (e.g. an acrylic multifilamentary tow) to a carbonaceous form while retaining the original fibrous configuration substantially intact. See, for instance, the following commonly assigned U.S. Pat. Nos. 3,539,295; 3,656,904; 3,723,157; 3,723,605; 3,775,520; 3,818,082; 3,844,822; 3,900,556; 3,914,393; 3,925,524; 3,954,950; and 4,020,273. During commonly practiced carbon fiber formation techniques a multifilamentary tow of substantially parallel or collimated carbon fibers is formed with the individual "rod-like" fibers lying in a closely disposed side-by-side relationship.

In order for the resulting carbon fibers to serve well as fibrous reinforcement within a continuous phase of resinous material, it is essential that the individual fibers be well dispersed within the matrix-forming resinous material prior to its solidification. Accordingly, it is essential when forming a composite article of optimum physical properties that the resinous material well impregnate the multifilamentary array of the carbon fibers so that resinous material is present to at least some degree between the individual fibers. If this does not occur, resin rich areas and voids will tend to be present in the resulting composite article.

See, the disclosures of U.S. Pat. Nos. 3,704,485; 3,795,944; 3,798,095; and 3,873,389 where the pneumatic spreading of carbon fibers was proposed prior to their resin impregnation. It has been found, however, that the pneumatic treatment of the carbon fibers to accomplish decollimation without spreading has tended to damage to an excessive degree the relatively delicate fibers frequently to the extent of fiber breakage, thereby creating an additional problem for those who choose to practice this additional process step and/or those carrying out the subsequent processing of the fibrous material.

In U.S. Pat. No. 4,466,949 is proposed a process for interconnecting ends of precursor yarns used in the production of carbon fibers through localized entanglement created by a fluid jet.

It has been recognized that the filaments of ordinary textile yarns can be interlaced or intermingled in order to improve their handling characteristics, etc. See, for instance, the disclosures of U.S. Pat. Nos. 2,985,995; 3,017,737; 3,110,151; 3,115,691; 3,262,179; 3,364,537; 3,563,021; 3,603,043; 3,701,248; 3,727,274; and 4,096,890.

It also has been recognized in the prior art that it has been necessary to apply a protective size to the surface of multifilamentary yarn bundles of carbon filaments prior to weaving the same to form a reinforcing fabric because of their extremely delicate nature. Different protective sizes sometimes are required for use with different matrix-forming resins, and in at least some instances the presence of even the best available protective sizes may be detrimental to the mechanical properties of the woven fabric reinforced composite article which ultimately is formed. For instance, the size may degrade upon exposure to highly elevated temperatures and/or otherwise may interfere with the adhesion between the reinforcing fibers and the matrix resin.

It is an object of the invention to provide an improved carbon fiber multifilamentary tow which is particularly suited for resin impregnation and resin retention.

It is an object of the invention to provide an improved carbon fiber multifilamentary tow which is particularly suited for impregnation with a matrix-forming resin to form a quality composite article.

It is an object of the invention to provide an improved carbon fiber multifilamentary tow wherein the individual filaments are randomly decollimated and commingled with numerous cross-over points (as specified) and are well adapted to receive and retain a matrix-forming resin.

It is an object of the present invention to provide an improved substantially void-free composite article comprising a solid resinous matrix material and the improved carbon fiber multifilamentary tow of the present invention incorporated herein as fibrous reinforcement.

It is an object of the present invention to provide an improved carbon fiber multifilamentary tow which is particularly suited for resin impregnation and in a preferred embodiment is substantially free of a size upon its surface.

It is an object of the present invention to provide an improved carbon fiber multifilamentary tow which in a preferred embodiment has been found to be capable of readily undergoing mechanized processing and handling in the absence of a protective size.

It is another object of the present invention to provide an improved process for weaving a fabric suitable for use as fibrous reinforcement in a resinous matrix material wherein the fabric incorporates a plurality of multifilamentary yarn bundles comprising adjacent substantially continuous carbonaceous filaments containing at least 70 percent carbon by weight.

It is a further object of the present invention to provide an improved woven fabric suitable for use as fibrous reinforcement in a resinous matrix material which incorporates a plurality of unsized multifilamentary yarn bundles comprising substantially continuous carbonaceous filaments containing at least 70 percent carbon by weight.

These and other objects, as well as the scope, nature, and utilization of the claimed invention will be apparent to those skilled in the art from the following detailed description and appended claims.

SUMMARY OF THE INVENTION

It has been found that a multifilamentary tow of carbonaceous fibrous material which is particularly suited for use as fiber reinforcement in a resin matrix comprises approximately 1,000 to 50,000 adjacent substantially continuous filaments containing at least 70 percent carbon by weight having a length of at least 100 meters, wherein the individual filaments of the multifilamentary tow are randomly decollimated and commingled with numerous filament cross-over points throughout the length of the multifilamentary tow so as to create a multitude of intertices between adjacent filaments which are well adapted to receive and retain a matrix-forming resin as evidenced by the ability of the filaments of the multifilamentary tow when subjected to the flaring test described herein while in a substantially untwisted state to resist lateral expansion to a width which is as much as three times the original width as a result of the commingling of adjacent filaments.

It has been found in a process for weaving a fabric suitable for use as fibrous reinforcement in a resinous matrix material wherein the fabric incorporates a plurality of multifilamentary yarn bundles comprising adjacent substantially continuous carbonaceous filaments containing at least 70 percent carbon by weight that improved results are achieved by supplying said multifilamentary yarn bundles during said weaving in an unsized form wherein the individual filaments of the multifilamentary yarn bundles are randomly decollimated and commingled with numerous filament cross-over points throughout their lengths so as to create a multitude of interstices between adjacent filaments which are well adapted to receive and retain a matrix-forming resin as evidenced by an ability of the filaments of the yarn bundles when subjected to the flaring test described herein while in a substantially untwisted state to resist lateral expansion to a width which is as much as one and one-half times the original width as a result of the commingling of adjacent filaments.

It has been found that an improved woven fabric suitable for use as fibrous reinforcement in a resinous matrix material which incorporates a plurality of multifilamentary yarn bundles comprising substantially continuous carbonaceous filaments containing at least 70 percent carbon by weight employs unsized multifilamentary yarn bundles which are randomly decollimated and commingled with numerous filament cross-over points throughout their lengths so as to create a multitude of interstices between adjacent filaments which are well adapted to receive and retain a matrix-forming resin as evidenced by an ability of the filaments of the yarn bundles when subjected to the flaring test described herein while in a substantially untwisted state to resist lateral expansion to a width which is as much as one and one-half times the original width as a result of the commingling of adjacent filaments.

BRIEF DESCRIPTION OF THE PHOTOGRAPHS AND DRAWINGS

FIG. 1 shows with magnification two representative segments of generally flattened multifilamentary tows of carbonaceous fibrous materials comprising approximately 3,000 adjacent substantially continuous filaments containing at least 90 percent carbon by weight while present at ambient conditions and lying on a solid surface. The tow on the left has a width of approximately 0.18 cm. and is representative of the prior art wherein the individual filaments of the tow exhibit an inherent tendency to laterally spread because of their rod-like collimated nature and a substantial absence of cross-over points. The tow on the right is that of Example II, has a width of approximately 0.13 cm., and is representative of the present invention wherein the individual filaments of the tow are randomly decollimated and commingled with numerous filament cross-over points which create a multitude of interstices between adjacent filaments which are well adapted to receive a matrix-forming resin. It will be noted that the tow on the right while containing the same number of filaments as the tow on the left exhibits a substantially lesser tendency to laterally spread at ambient conditions. It should be understood, however, that such flaring at ambient conditions is different from the flaring test discussed hereafter and in the claims which is carried out by the use of a liquid as described. In each instance an epoxy size is present upon the filaments.

FIG. 2 on the left shows a representative segment of a generally flattened multifilamentary tow of carbonaceous fibrous material of Example I of approximately 3,000 filaments following the flaring test discussed hereafter. Such tow on the left exhibited an average width of approximately 0.13 cm. prior to subjection to the flaring test and an average width of approximately 0.18 cm. following subjection to the flaring test. On the right of FIG. 2 is shown for comparative purposes following subjection to the flaring test a similarly prepared segment of a generally flattened multifilamentary tow of carbonaceous fibrous material of a impingement with a stream of liquid. Such tow on the right exhibited an average width of approximately 0.18 cm. prior to subjection to the flaring test and an average width of approximately 1.5 cm. following subjection to the flaring test.

FIG. 3 on the left shows a representative segment of a generally flattened multifilamentary tow of carbaceous fibrous material of Example II consisting of approximately 3,000 filaments following the flaring test described hereafter. Such tow on the left exhibited an average width of approximately 0.13 cm prior to subjection to the flaring test and an average width of approximately 0.18 cm. following subjection to the flaring test. On the right of FIG. 3 is shown for comparative purposes following subjection to the flaring test a segment of generally flattened commercially available approximately 3,000 filament tow of carbonaceous fibrous material which is marketed by the Union Carbide under the THORNEL 300 designation. Such tow on the right exhibited an average width of approximately 0.15 cm prior to subjection to the flaring test and an average width of approximately 1.3 cm. following subjection to the flaring test.

FIG. 4 on the left shows for comparative purposes a commercially available generally flattened approximately 3,000 filament tow of carbonaceous fibrous material which is marketed by Hercules Incorporated under the designation AS4-W following subjection to the flaring test described hereafter. Such tow on the left exhibited an average width of approximately 0.13 cm. prior to subjection to the flaring test and an average width of approximately 1.5 cm. following subjection to the flaring test. On the right of FIG. 4 is shown for comparative purposes following subjection to the flaring test a representative segment of a commercially available generally flattened approximately 12,000 filament tow of carbonaceous fibrous material which is also marketed by Hercules Incorporated under the designation AS4-W. Such tow on the right exhibited an average width of approximately 0.3 cm. prior to subjection to the flaring test and an average width of approximately 2.3 cm. following subjection to the flaring test.

FIG. 5 on the left shows a representative segment of a generally flattened multifilamentary tow of carbonaceous fibrous material of Example III of approximately 12,000 filaments following the flaring test discussed hereafter. Such tow on the left exhibited an average width of approximately 0.25 cm. prior to subjection to the flaring test and an average width of approximately 0.33 cm. following subjection to the flaring test. On the right of FIG. 5 is shown for comparative purposes following subjection to the flaring test a segment of a commercially available generally flattened approximately 12,000 filament tow of a carbonaceous fibrous material which is marketed by Hercules Incorporated under the designation AS2-G. Such tow on the right exhibited an average width of approximately 0.33 cm. prior to subjection to the flaring test and an average width of approximately 2.5 cm. following subjection to the flaring test.

FIG. 6 on the left shows a representative segment of a generally flattened multifilamentary tow of carbonaceous fibrous material of Example IV consisting of approximately 12,000 filaments following the flaring test decribed hereafter. Such tow on the left exhibited an average width of approximately 0.4 cm. prior to subjection to the flaring test and an average width of approximately 0.4 cm. following subjection to the flaring test. On the right of FIG. 6 is shown for comparative purposes following subjection to the flaring test a similarly prepared segment of a generally flattened multifilamentary tow of carbonaceous fibrous material of approximately 12,000 filaments which had not undergone impingement with a stream of liquid. Such tow on the right exhibited an average width of approximately 0.4 cm. prior to subjection to the flaring test and an average width of approximately 3.3 cm. following subjection to the flaring test.

FIG. 7 on the left shows for comparative purposes a representative segment of a commercially available generally flattened approximately 12,000 filament tow of carbonaceous fibrous material which is marketed by Hitco under the HYTEX designation following the flaring test described hereafter. Such tow on the left exhibited an average width of approximately 0.4 cm. prior to subjection to the flaring test and an average width of approximately 2.5 cm. following subjection to the flaring test. On the right of FIG. 7 is shown for comparative purposes following subjection to the flaring test a representative segment of commercially available generally flattened approximatey 12,000 filament tow of carbonaceous fibrous material which is marketed by the Union Carbide Corporation under the THORNEL 300 designation. Such tow on the right exhibited an average width of approximately 0.46 cm. prior to subjection to the flaring test and an average width of approximately 2.5 cm. following subjection to the flaring test.

FIG. 8 is an enlarged plan view of a segment of a representative woven fabric in accordance with the present invention having a plain weave configuration which is suitable for improved service as fibrous reinforcement in a resinous matrix material. The woven fabric incorporates a plurality of unsized multifilamentary yarn bundles which well resist lateral expansion. Each yarn bundle consists of approximately 3,000 substantially continuous carbon filaments. The fabric consists of approximately $12\times22$ yarn bundles per inch, has a thickness of approximately 0.013 inch, and exhibits an areal weight of 190 grams/m.$^2$.

FIG. 9 is an enlarged plan view of a segment of a representative woven fabric in accordance with the present invention having an 8-harness double-faced satin weave configuration which is suitable for improved service as fibrous reinforcement in a resinous matrix material. The woven fabric incorporates a plurality of unsized multifilamentary yarn bundles which well resist lateral expansion. Each yarn bundle consists of approximately 3,000 substantially continuous filaments. The fabric consists of approximately $24\times23$ yarn bundles per inch, has a thickness of approximately 0.024 inch, and exhibits an areal weight of 374 grams/m.$^2$.

DESCRIPTION OF PREFERRED EMBODIMENTS

The Starting Material

Figure 1:
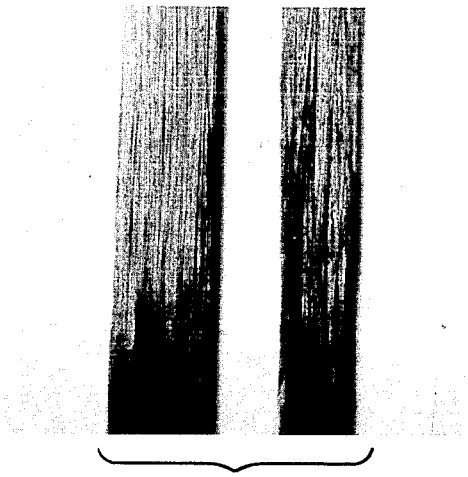

A multifilamentary tow of acrylic filaments may be selected for use as the precursor to form the multifilamentary tow of carbonaceous fibrous material of the present invention. Such acrylic tow may be formed by conventional solution spinning techniques (i.e., dry spinning or wet spinning) or by melt spinning and the filaments drawn to increase their orientation. As is known in the art, dry spinning is commonly conducted by dissolving the polymer in an appropriate solvent, such as N,N-dimethylformamide or N,N-dimethylacetamide, and passing the solution through an opening of predetermined shape into an evaporative atmosphere (e.g., nitrogen) in which much of the solvent is evaporated. Wet spinning is commonly conducted by passing a solution of the polymer through an opening of predetermined shape into an aqueous coagulation bath.

The acrylic polymer may be either an acrylonitrile homopolymer or an acrylonitrile copolymer containing at least about 85 mole percent of acrylonitrile units and up to about 15 mole percent of one or more other monovinyl units. In a preferred embodiment the acrylic polymer is either an acrylonitrile homopolymer or an acrylonitrile copolymer containing at least about 95 mole percent of acrylonitrile units and up to about 5 mole percent of one or more monovinyl units. Such monovinyl units may be derived from a monovinyl compound which is copolymerizable with acrylonitrile units such a styrene, methyl acrylate, methyl methacrylate, vinyl acetate, vinyl chloride, vinylidene chloride, vinyl pyridine, and the like.

The precursor multifilamentary tow may be composed of a plurality of substantially parallel and substantially untwisted filaments. Such individual precursor filaments commonly possess a denier per filament of approximately 0.4 to 2.0, and most preferably approximately 0.9. The multifilamentary tow commonly is composed of approximately 1,000 to 50,000 substantially aligned substantially continuous filaments (e.g., approximately 3,000, 6,000 or 12,000 continuous filaments).

Various catalytic agents which serve to expedite or to otherwise advantageously influence the thermal stabilization reaction may be incorporated within the filaments of the multifilamentary tow.

The Formation of Carbon Fibers

The multifilamentary tow of acrylic fibers may be passed through a plurality of heating zones provided with appropriate gaseous atmospheres while substantially suspended therein to form a multifilamentary fibrous product which contains at least 70 percent (preferably at least 90 percent) carbon by weight.

The multifilamentary tow of acrylic fibers may be initially passed through a stabilization zone which is provided with a heated oxygen-containing atmosphere wherein the filaments are rendered black in appearance, non-burning when subjected to an ordinary match flame, and capable of undergoing carbonization. The preferred oxygen-containing atmosphere is air. A temperature gradient may be provided in the thermal stabilization zone, or the multifilamentary tow optionally may be passed through a plurality of discrete zones which are provided at successively elevated tempertures. Alternatively, a single stabilization zone may be provided which is maintained at a substantially constant temperature. The stabilization reaction of the acrylic fibrous material commonly involves (1) an oxidative cross-linking reaction of adjoining molecules as well as (2) a cyclization reaction of pendant nitrile groups to a condensed dihydropyridine structure. The thermal stabilization reaction commonly is carried out at a temperature in the range of approximately 220° C. to 320° C. up to a period of several hours. Various known techniques for expediting the thermal stabilization reaction optionally may be employed. Representative thermal stabilization techniques which may be selected are disclosed in commonly assigned U.S. Pat. Nos. 3,539,295; 3,592,595; 3,650,668; 3,656,882; 3,656;883; 3,708,326; 3,729,549; 3,813,219; 3,820,951; 3,826,611; 3,850,876; 3,923,950; 3,961,888; 4,002,426; 4,004,053; and 4,374,114; and British patent No. 1,278,676 which are herein incorporated by reference.

The multifilamentary tow of thermally stabilized acrylic filaments may be passed in the direction of its length through a carbonization zone provided with a non-oxidizing atmosphere which is maintained at a temperature of at least 600° C. (e.g., 1000 to 2000° C., or more). Suitable non-oxidizing atmospheres include nitrogen, argon, and helium. The carbonization zone optionally may be provided with a temperature gradient which progressively increases, or the multifilamentary tow optionally may be passed through a plurality of discrete zones provided at successively elevated temperatures. The multifilamentary tow of thermally stabilized acrylic filaments is retained within the carbonization zone for sufficient time to yield a carbonaceous fibrous material which contains at least 70 percent carbon by weight e.g., at least 90 or at least 95 percent carbon by weight in some embodiments). If the temperature of the carbonization zone rises to 2000° C. (e.g., 2000 to 3000° C.), substantial amounts of graphitic carbon will be present in the product and the product will tend to exhibit higher modulus values. Representative carbonization techniques which may be selected are disclosed in commonly assigned U.S. Pat. Nos. 3,539,295; 3,677,705; 3,775,520; 3,900,556; 3,914,393; 3,954,950; and 4,020,275.

The resulting multifilamentary tow of carbonaceous fibrous material which contains at least 70 percent (preferably at least 90 percent) carbon by weight may next be subjected to a surface treatment whereby its ability to adhere to a resinous matrix material (e.g., an epoxy resin) is enhanced. During such surface treatment the resulting carbonaceous fibrous material may be passed in the direction of its length through an appropriate zone whereby the desired surface treatment is carried out in accordance with known techniques. Representative surface treatment techniques which may be elected are disclosed in commonly assigned U.S. Pat. Nos. 3,723,150; 3,723,607; 3,745,104; 3,754,957; 3,859,187; 3,894,884; and 4,374,114 which are herein incorporated by reference.

The Decollimation Treatment

The filament decollimation may advantageously be carried out in accordance with the teachings of our commonly assigned U.S. Ser. No. 527,728, filed Aug. 30, 1983, and 647,739, filed Sept. 6, 1984, which are herein incorporated by reference.

In accordance with the concept of the present invention the multifilamentary tow during at least one stage of its processing is subjected to the impingement of at least one stream of a liquid whereby the parallel relationship of the filaments is substantially disrupted in the substantial absence of filament damage with the filaments becoming decollimated (i.e., decolumnized) to a degree sufficient to enable the resulting carbonaceous fibrous material to be more readily impregnated by and disposed within a matrix-forming resin. Such treatment may be carried out at various times throughout the processing of the multifilamentary tow. In the event the decollimation is accomplished at an early point in time, the desired decollimation is substantially retained during subsequent processing. Representative times when decollimation in accordance with the concept of the present invention can be carried out include (1) treatment of the multifilamentary acrylic precursor prior to thermal stabilization, (2) treatment of the thermally stabilized multifilamentary tow prior to carbonization, (3) treatment of the resulting multifilamentary carbonaceous fibrous material containing at least 70 percent carbon by weight following its formation and before or after its surface treatment (if any), and (4) treatment of the multifilamentary tow before or during the application of a protective size. In a preferred embodiment the decolumnization in accordance with the concept of the present invention is carried out subsequent to passage through the thermal stabilization zone and prior to passage through a carbonization zone. Such filaments additionally are dried prior to the carbonization step if they are impinged by a liquid immediately following thermal stabilization.

In a preferred embodiment the multifilamentary tow is completely submerged with a liquid when being impinged by the at least one stream of liquid to accomplish the desired decollimation. The liquid in which the multifilamentary tow is submerged is preferably the same liquid which forms the at least one stream which contacts the multifilamentary tow. Alternatively, the multifilamentry tow may be simply suspended at ambient conditions when impinged by the liquid. The particularly preferred liquid for use in the process is water. Other liquids may be selected which are capable of being readily removed from the multifilamentary material prior to subsequent processing. Other representative liquids include ketones such as acetone; alcohols such as methyl alcohol, ethyl alcohol, and ethylene glycol; aldehydes; chlorinated hydrocarbons; glyme, etc. Alternatively, in a less preferred embodiment the liquid may be a conventional protective size composition (e.g., an aqueous epoxy size emulsion, etc.) which heretofore has commonly been applied to a carbon fiber product subsequent to its complete formation particularly if weaving is contemplated. In this instance the resin portion of the size would be permanently retained upon the surfaces of the filaments and the water portion of the size removed in a conventional drying step In a preferred embodiment a plurality of streams of liquid are caused to strike the multifilamentary fibrous material while it continuously passes adjacent liquid spray jets (i.e., impingement jets) situated along the pathway of the fibrous material. The number of streams may be varied widely with such streams preferably being directed at least partially to different surfaces (i.e., the sides) of the multifilamentary fibrous bundle which is being at least partially decollimated. For instance, 2, 3, 4, 5, 6, 7, etc. streams may be employed. In a particularly preferred embodiment the multifilamentary fibrous material is passed in the direction of its length through a laterally enclosed zone while being subjected to the impact of the at least one stream of liquid. For instance, the multifilamentary fibrous material may be passed through and axially suspended within a duct while being impinged with one or more liquid streams which emerge from ports in the walls of the duct and which are directed inwardly to strike the multifilamentary fibrous material. In such embodiment the multifilamentary fibrous material does not detrimentally contact the walls of the duct.

The angle at which the streams strike the multifilamentary fibrous material may be varied widely. For instance, the streams may strike the multifilamentary fibrous material at an angle of 90 degrees with respect to the axis of the multifilamentary bundle. Alternatively, the stream angle may be directed greater than or less than 90 degrees with the respect to the approaching multifilamentary fibrous material. For instance, the at least one stream may strike the multifilamentary fibrous material at an angle of approximately 135 degrees with respect to the approaching multifilamentary fibrous material and serve to generally oppose the foward movement of the multifilamentary tow. Such angle will tend to accomplish maximum decollimation for a given flow rate and is particularly useful when decollimation is accomplished prior to the carbonization step. Alternatively, the at least one stream may strike the multifilamentary tow at an angle of approximately 45 degrees with respect to the approaching multifilamentary fibrous material and serve to generally aid the forward movement of the multifilamentary tow. Such angle can be used to particular advantage subsequent to the carbonization step. Such 45 degree impingement will require a stream velocity approximately $1\frac{1}{2}$ times that required with a 90 degree impingement to accomplish the same approximate level of decollimation.

A preferred apparatus arrangement for accomplishing the decollimation is as described in U.S. Pat. No. 3,727,274 which is herein incorporated by reference. For instance, the multifilamentary fibrous material may be passed through a duct which optionally is of a cylindrical configuration and while present therein be struck by streams which emerge from three fluid outlets located in the wall of the duct. For instance, on one side of the cylinder two substantially parallel streams may emerge which are substantially tangential to the bore of the cylinder, and on the opposite side one stream may emerge which is positioned radially to the cylinder with all of the outlets being in a common plane and substantially perpendicular to the path of the multifilamentary fibrous material and to the cylinder. The entry and exit portions at the cylinder through which the multifilamentary fibrous material passes may be flared. Suitable diameters for the cylinder commonly range in size from slightly larger than the outer dimensions (i.e., width) of the multifilamentary fibrous material up to approximately 0.5 inch. For instance, a cylindrial bore diameter when processing a 3,000 filament tow commonly may be 0.105 inch, 0.120 inch, or 0.141 inch. It should be understood, however, that in all instances the configuration of the cylinder is selected so as to well accommodate the multifilamentary fibrous material undergoing treatment.

While the multifilamentary tow is subjected to the impingement of the at least one stream of liquid, the longitudinal tension hereon is adjusted so that at least some lateral displacement of the individual filaments present therein is possible in the substantial absence of filament damage. For instance, a longitudinal tension of approximately 0.003 to 1.0 grams per denier, and most preferably approximately 0.03 to 0.08 grams per denier, conveniently may be employed. It is possible for the multifilamentary tow to possess a low level of twist during the decollimation treatment described herein; however, in a preferred embodiment the multifilamentary fibrous material is substantially untwisted during the decollimation treatment. Additionally, in preferred embodiments the liquid streams are provided at a pressure of aproximately 5 to 200 or more psig, and most preferably at a pressure of approximately 50 to 100 psig when conducted prior to carbonization, and most preferably at pressure of approximately 10 to 30 psig when conducted after carbonization. The velocity of the liquid streams commonly is approximately 5 to 100 feet per second, and most preferably approximately 45 to 75 feet per second when conducted prior to carbonization, and most preferably approximately 20 to 40 feet per second when conducted after carbonization. When three liquid streams are utilized the stream diameter conveniently may be approximately one-third the diameter of the cylindrical bore through which the multifilamentary fibrous material passes.

The liquid impingement treatment can be carried out at a relatively low noise level and surprisingly has been found to be capable of accomplishing the desired decolumnization in the substantial absence of filament damage. Accordingly, one effectively overcomes the filament damage problems found to be associated with the pneumatic decollimation of carbon fibers. The substantial absence of filament damage associated with the process described may be evidenced by a retention of at least 90 percent (preferably at least 95 percent) of the tensile strength of the carbonaceous fibrous material when compared to a similarly prepared collimated (i.e., fully columnized) carbonaceous fibrous material which was not subjected to the liquid impingement. In some instances an enhancement of the tensile strength is observed following decollimation (e.g., up to a 5 percent or more enhancement).

In commonly assigned U.S. Ser. No. 717,405, filed Mar. 29, 1985, of John E. McAliley and James R. Crozier, Jr., entitled "Yarn Entangling Methods and Apparatus" is disclosed a preferred apparatus arrangement for simultaneously decollimating a plurality of multifilamentary tows. The disclosure of this copending application is herein incorporated by reference.

The Improved Multifilamentary Tow of The Present Invention

The multifilamentary tow of carbonaceous fibrous material of the present invention does not possess the relatively uniform side-by-side collimation encountered in multifilamentary tows of carbon filaments of the prior art. More specifically, the individual filaments tend to be displaced from adjacent filaments in a more or less random fashion and are removed from precisely parallel axes. The filaments tend to be mildly bulked, entangled and commingled, with numerous cross-over points. The fibrous structure accordingly is more open between adjacent filaments thereby creating a multitude of interstices between filaments which are well adapted to receive and retain a matrix-forming resin in a subsequent processing step.

The resulting multifilamentary tow of carbonaceous fibrous material has a length of at least 100 meters and comprises approximately 1,000 to 50,000 adjacent substantially continuous filaments containing at least 70 percent carbon by weight (e.g., at least 90 or at least 95 percent carbon by weight). The individual filaments commonly exhibit a denier per filament of approximately 0.2 to 1.5 e.g., approximately 0.3 or 0.6). The multifilamentary tow of carbonaceous fibrous material commonly exhibits a generally flattened configuration and has a width of approximately 0.02 to 2.0 cm. with the greater widths within the range specified commonly being associated with a multifilamentary tow having a larger number of adjoining substantially continuous filaments within the range earlier specified. In preferred embodiments the multifilamentary tow comprises approximately 3,000, 6,000, or 12,000 substantially continuous filaments. A generally flattened multifilamentary tow comprising approximately 3,000 subtantially continuous filaments commonly has a width of approximately 0.04 to 0.4 cm. (e.g., approximately 0.13 cm.). A generally flattened multifilamentary tow comprising approximately 6,000 substantially continuous filaments commonly has a width of approximately 0.06 to 0.6 cm. (e.g., approximately 0.18 cm.). A generally flattened multifilamentary tow comprising approximately 12,000 substantially continuous filaments commonly has a width of approximately 0.1 to 1.0 cm. (e.g., approximately 0.25 cm.).

The multifilamentary tow of carbonaceous fibrous material in accordance with the present invention preferably is of good strength and preferably exhibits a tensile strength of at least 400,000 psi, and most preferably a tensile strength of at least 450,000 psi (e.g., at least 500,000 psi or at least 700,000 psi). As will be apparent to those skilled in the art, the higher tensile strengths commonly are observed with fibrous materials of the higher carbon contents. When the carbonaceous fibrous material contains only 70 percent carbon by weight, a tensile strength of at least 100,000 psi commonly is encountered. Accordingly, multifilamentary tow tensile strengths of approximately 100,000 to 800,000 psi commonly are exhibited. Such tensile strength may be determined by standard techniques, such as that described in Celanese Corporation Bulletin CFTI 10/80 entitled "Celion Carbon Fibers Test Method Procedure 76A-ECO1".

In a preferred embodiment the multifilamentary tow of carbonaceous fibrous material is substantially free of a twist. However, if desired a real or false twist may be imparted to or superimposed upon a preexisting twist of the adjacent multifilamentary filaments following the decollimation treatment. For instance, a twist of approximately 0.1 to 6.0 turns per inch (e.g., 0.1 to 1.0 turns per inch) conveniently can be exhibited in the product. However, as discussed hereafter such real or false twist must be removed prior to carrying out the flaring test and the entanglement index test discussed hereafter. Also, the multifilamentary tow of carbonaceous fibrous material may bear a size (e.g., epoxy, polyimide, etc.) upon its surface or be substantially free of a size upon its surface. Such multifilamentary tow while bearing a protective size weaves well, and if desired may bear a lesser quantity of protective size then is commony employed in the prior art. Representative protective size levels commonly range from 0.2 to 10 percent by weight. However, as discussed hereafter such size must be substantially removed during the carrying out of the flaring test described hereafter, and such size must be substantially removed and a standard soft size must be applied to the multifilamentary tow when carrying out the entanglement index test discussed hereafter. In a particularly preferred embodiment the multifilamentary tow is unsized. As described hereafter, such unsized multifilamentary yarn bundles when greatly commingled have been found to be particularly suited for weaving.

Within the multifilamentary tow of carbonaceous fibrous material in accordance with the present invention the individual filaments are randomly decollimated and are commingled with numerous filament cross-over points throughout the length of the multifilamentary tow so as to create a multitude of interstices between adjacent filaments which are well adapted to receive and retain a matrix-forming resin.

Such internal structure can be conveniently confirmed by use of the flaring test described hereafter. When subjected to such test in a substantially untwisted state, the multifilamentary tow of carbonaceous fibrous material according to the present invention resists lateral expansion to a width which is as much as three times the original width as a result of the commingling of adjacent filaments. In a preferred embodiment the multifilamentary tow resists lateral expansion to a width which is as much as two times the original width, and in a most preferred embodiment resists lateral expansion to a width which is as much as one and one-half times the original width (e.g., to a width which is as much as one and one-fourth times the original width). When determining the level of lateral expansion for a given specimen, one divides the width at the conclusion of the flaring test by the original width of the specimen. When the individual filaments of multifilamentary tow of carbonaceous fibrous material are fully collimated in a generally rod-like configuration in the substantial absence of cross-over points, they will expand to a greater degree when subjected to the flaring test as described hereafter thereby indicating their inherent configuration.

When carrying out the flaring test, a representative 8 inch segment of the multifilamentary tow of carbonaceous fibrous material is selected. If a twist is present along the length of the tow, it is first physically removed with care without otherwise altering its inherent interfilamentary configuration so as to provide the tow in a substantially untwisted state. If a size or other substance which would cause the filaments to adhere with each other is present upon the surface of the multifilamentary tow, it is essential that the flaring test be conducted in a liquid which is capable of efficiently substantially dissolving such size or other substance without otherwise modifying the inherent characteristics of the tow. The liquid of choice often is acetone; however, methylene chloride, ethanol, methanol, or N-methylpyrrolidine, etc., may be the preferred solvent in those instances in which the size is not sufficiently soluble in acetone. The solvent selected should be of a relatively low viscosity, have relatively low surface tension, and have the ability to readily wet the multifilamentary tow of carbonaceous fibrous material. The viscosity and surface tension of the liquid generally should be similar to or less than those of water.

The solvent is initially placed in a depth of approximately 0.6 to 1.25 cm. in a flat-bottomed tray having a width of approximately 15 cm. and a length of approximately 25 cm. The sides of the tray conveniently can have a height of approximately 3.5 to 4.0 cm. The eight inch segment of the multifilamentary tow next is placed lengthwise in the flat-bottomed tray containing the liquid while present on a level surface and is allowed to remain static for approximately 60 seconds during which time any size or other substance present upon its surface is substantially dissolved. One side of the tray is next lifted to a height of approximately 1 cm. over a period of approximately 1 second with the opposite edge of the tray remaining in contact with the surface upon which it is placed. The side of the tray which was lifted next is returned to the surface upon which it was placed over a period of approximately 1 second. This procedure immediately is next repeated while lifting the opposite side of the tray, and is continued until each side of the tray has been lifted 5 times. The multifilamentary tow present in the liquid next is observed to determine its ability to resist lateral expansion as a result of the commingling of adjacent filaments. The photographs of FIGS. 2 to 7 were obtained at the conclusion of this flaring test after the solvent had been evaporated and the average widths were measured as reported. Such widths remained unchanged during the time required to evaporate the solvent.

The decollimated and commingled multifilamentary tow of carbonaceous fibrous material according to the present invention also can be characterized by use of the entanglement index test procedure described hereafter. It has been found that the multifilamentary tow of carbonaceous fibrous material of the present invention commonly exhibits a normalized entanglement index value of at least 100 gram-inches while in a substantially untwisted state, and preferably is of at least 150 gram-inches (e.g., approximately 150 to 300 gram-inches). Lower entanglement index values indicate a high degree of filament collimation and the substantial absence of filament commingling and cross-overs. An average of at least 30 representative test specimens from along the length of the multifilamentary tow should be made when arriving at a normalized entanglement index value for a given tow. Such normalized entanglement index value may be determined in accordance with a standard needle pull test using the equation which follows:

$$\text{normalized entanglement index in gram-inches} = \frac{\text{average observed entanglement index value for at least 30 test specimens in gram-inches} \times 4000}{\text{filament count of the multifilamentary tow}}$$

The entanglement index test procedure requires the use of steps (1) through (4) as follows:

(1) It is essential that any true or false twist present in the multifilamentary tow first be substantially removed so as not to interfere with the entanglement index test. This can be done by physically untwisting the same with care in the absence of any substantial interference with the remainder of the interfilamentary configuration. For instance, such twist can be conveniently removed by gently passing a representative test specimen of the multifilamentary tow between the thumb and index fingers.

(2) If a size or other substance is present upon the surface of the multifilamentary tow it next is substantially removed so that it will not influence the entanglement index values observed. For instance, some sizes or finishes used on commercially available carbon fiber tows tend to be stiff and tend to cause the adjacent filaments to unduly cling to one another thereby improperly raising the entanglement index values observed even though the tows are highly collimated with an insignificant level of filament cross-overs. The exact method chosen to remove a size or finish coating will be influenced by its chemical composition and physical properties. It has been found that many size or finish coatings can be quickly removed through vaporization or burning when a test specimen of the tow is heated to approximately 500° to 800° C. by direct resistance heating for a brief period of time. For instance, a 1 meter segment of the multifilamentary tow while flat and untwisted can be mounted so that its ends are connected to standard welding electrode clamps. Prior to securing the ends of the multifilamentary tow in the clamps it is recommended that any size or finish be first removed from such ends by an appropriate solvent for the size (e.g., acetone, methylene chloride, ethanol, methanol, N-methylpyrrolidine, etc.) in order to insure good electrical contact between the clamps and the multifilamentary tow. A standard voltage source rated for at least 20 amps is used to cause a direct electric current to flow through the multifilamentary tow to accomplish the desired heating and the substantial vaporization of the size. A representative treatment for a 3,000 filament tow is 135 volts for 6 seconds. A representative treatment for a 6,000 filament tow is 120 volts for 5 seconds. A representative treatment for a 12,000 filament tow is 105 volts for 4 seconds. It is important that the size removal technique which is selected not leave a residue upon the surface of the filaments which will cause the individual filaments to unduly adhere or otherwise firmly bond together.

(3) Next a standard soft epoxy size is added to the filaments of the multifilamentary tow in a concentration of approximately 0.7 to 2.0 percent by weight (preferably approximately 1.3 percent by weight). The standard size elected for this purpose is 4,4-isopropylidenediphenol-epichlorohydrin resin which is commercially available from the Shell Chemical Co. under the EPON 828 designation. Representative segments of the multifilamentary tow conveniently can be wound with the absence of overlap upon a perforated spool having a diameter of 4 inches while being careful to keep the tow specimens flat and not to introduce a twist. The perforated spool next can be submerged for 1 minute in a dilute solution of uncured 4,4-isopropylidene-diphenol-epichlorohydrin resin in an acetone solvent while subjected to mild ultrasonic agitation to insure good liquid penetration. A representative concentration for the resin in acetone for a 3,000 filament tow is 2.5 grams per liter. A representative concentration for the resin in acetone for a 6,000 filament tow is 3.8 grams per liter. A representative concentration for the resin in acetone for a 12,000 filament tow is 5.0 grams per liter. The perforated spool next is removed and is allowed to drain at ambient conditions for 2 minutes, and next is dried for 30 minutes at 100° C.

(4) Test specimens are removed from the perforated bobbin and are cut in lengths of 18 inches and are individually subjected to the standard needle pull test to arrive at an average entanglement index value for the multifilamentary tow. Such test conveniently can be conducted by use of a standard Instron tensile test instrument or the equivalent. One end of each specimen is clamp mounted to a fixed load cell at the top, a 50 gram weight is attached to the bottom of each specimen, the instrument is set to zero, the full scale load is set, a needle is inserted into the middle of the multifilamentary tow, and the needle is caused to move downward by the cross-head along an 8 inch section of the multifilamentary tow at a rate of 10 inches per minute. An integrator is used in conjunction with a tensile test instrument and the area under the resulting curve of the load (grams) vs. distance (inches) is determined and is expressed in gram-inches. For multifilamentary tows of approximately 3,000 or 6,000 filaments a full scale load of 200 grams conveniently can be used, and for a multifilamentary tow of approximately 12,000 filaments a full scale load of 500 grams conveniently can be used. The normalized entanglement index value computed as previously described enables one to compare the relative propensities of carbon fiber tows to receive a matrix-forming resinous material regardless of their filament count.

The more open structure of the multifilamentary tow of the present invention results from the filament commingling and numerous filament cross-over points and is well retained during subsequent processing of the multifilamentary material. The multifilamentary material of the present invention handles well, may be readily woven with or without a protective size, and may be processed efficiently as a prepreg material. Such multifilamentary fibrous material when incorporated in whole or in part as fibrous reinforcement in a solid resinous matrix material (e.g., an epoxy, polyimide, etc.) is capable of yielding an improved substantially void-free composite article. The multitude of interstices between adjoining filaments has been found to make possible an excellent combination of the fibrous reinforcement and the resinous matrix material. Since the resinous matrix material is able to well fill the interstices between adjoining filaments, the fibrous reinforcement of the present invention inherently becomes well dispersed within the resinous matrix material. The multifilamentary tow has a pronounced ability to pick up and to absorb resin prior to curing and to well retain such uncured resin throughout the duration of the curing process even if conducted under vacuum. The resulting composite article, accordingly, is substantially free of voids and resin-rich areas as commonly encountered in composite articles of the prior art. The improved internal nature of a composite article which incorporates the multifilamentary tow of the present invention can be confirmed by reflector plate or pulse echo techniques wherein ultrasonic sound waves strike the composite article and the presence or absence of voids is detected.

The improved multifilamentary tow product of the present invention handles well even under harsh conditions and may readily undergo weaving, processing as a prepreg roving, processing as a prepreg tape, filament winding, braiding, metal plating, pultrusion, etc.

The Improved Fabric Weaving Process and Woven Fabric of the Present Invention

Heretofore, in the prior art it has been required to apply a protective size to the surface of multifilamentary yarn bundles of carbon filaments prior to subjecting such fibers to mechanized weaving to form a fabric. The fragile and delicate nature of the carbon filaments has in the past made such protective size application necessary if the weaving operation is to be carried out without severely damaging the filaments to form a uniform and consistent woven fabric product. Previously a protective size has been selected which will be as compatible as possible with the resinous matrix material in which the fabric will ultimately be incorporated as fibrous reinforcement. Different matrix resins often have required the use of different size compositions. In at least some instances, even the best available protective sizes have proven to be detrimental to the mechanical properties of the woven fabric composite article which results. In the past the protective sizes employed commonly have been polymeric in nature or are capable of forming a synthetic resin upon curing. Such sizes commonly have heretofore been applied in a concentration of approximately 0.5 to 10 percent by weight. Often the size will degrade upon exposure to high temperatures and/or otherwise impede the formation of a strong bond between the fibrous reinforcement and the matrix resin.

In accordance with the concept of the present invention, it surprisingly has been found that the multifilamentary tows (i.e., multifilamentary yarn bundles) of delicate carbonaceous filaments heretofore discussed which exhibit the greatest resistance to lateral expansion in the flaring test are capable of being readily woven to form a quality reinforcing fabric while free of a protective size. The unsized multifilamentary yarn bundles selected for mechanized weaving are randomly decollimated and commingled with numerous filament cross-over points throughout their lengths so as to create a multitude of interstices between adjacent filaments which are well adapted to receive and retain a matrix-forming resin as evidenced by an ability of the filaments of the yarn bundles when subjected to the flaring test described herein while in a substantially untwisted state to resist lateral expansion to a width which is as much as one and one-half times the original width as a result of the commingling of adjacent filaments. In a preferred embodiment the multifilamentary yarn bundles resist lateral expansion to a width which is as much as one and one-fourth times the original width during the flaring test as a result of the commingling of adjacent filaments. In a particularly preferred embodiment the multifilamentary yarn bundles retain substantially the same width during the flaring test as that originally exhibited as a result of the commingling of adjacent filaments.

The multifilamentary yarn bundles selected for weaving commonly consist of approximately 1,000 to 50,000 substantially continuous filaments (e.g., 3,000 to 12,000 substantially continuous filaments). The carbonaceous filaments of the yarn bundles commonly have a denier per filament of 0.2 to 1.5 (e.g., approximately 0.3 or 0.6). In a preferred embodiment the carbonaceous filaments of the yarn bundles contain at least 90 percent carbon by weight (e.g., at least 95 percent carbon by weight). Also, in a preferred embodiment the unsized multifilamentary yarn bundles exhibit a tensile strength of at least 400,000 psi before and after weaving. In a more preferred embodiment the unsized multifilamentary yarn bundles exhibit a tensile strength of at least 450,000 psi (e.g., at least 500,000 psi or at least 700,000 psi) before and after weaving. The multifilamentary yarn bundles commonly will exhibit following weaving at least 90 percent of the tensile strength exhibited immediately prior to weaving, and commonly will exhibit a tensile strength of approximately 100,000 to 800,000 psi before and after weaving.

The unsized multifilamentary yarn bundles preferably are substantially free of a twist when woven. However, such yarns optionally may be twisted (e.g., they may possess a twist of approximately 0.1 to 6.0 turns per inch). Additionally, some types of weaving equipment will inherently impart a very slight twist to the filling yarn (i.e., the weft yarn) during weaving.

At the time of weaving one may optionally interweave with the bundles of carbon filaments heretofore discussed materials of a different chemical composition which will not substantially interfere with the intended end use for the woven fabric. Also, light-colored tracer yarns of aramid fibers or other high performance fibers may be woven into the otherwise black fabric at predetermined spacings to aid in the expeditious alignment of the reinforcing fabric during composite formation.

Conventional commercially available mechanized weaving equipment heretofore used to weave carbon filament bundles bearing a protective size may be utilized when carrying out the improved weaving process of the present invention. The width of the woven fabric desired will, of course, influence the size of the weaving loom which is selected. For instance, the woven fabric may in some instances be a relatively narrow woven tape having a width of less than one inch (e.g., 0.5 inch). However, in preferred embodiments, the fabric formed will have a more substantial width (e.g., a width of 24 inches, 42 inches, or more).

Mechanical weaving equipment preferably is selected which interlaces the warp and filling bundles (i.e., the weft bundles) at an angle of 90 degrees with respect to each other. However, other weaving angles may be selected. Each of the warp bundles can be led from a multi-package creel through appropriate guide means to the weaving loom. Conventional loom settings generally can be used to form a satisfactory woven product in the absence of significant operability constraints. However, in some instances, it may be desirable to reduce the loom speed slightly (e.g., 10 to 15 percent) from that commonly used when weaving fully collimated carbon filament yarn bundles which bear a standard epoxy size in order to achieve optimum weaving stability. Typical weaving speeds when forming a fabric of a plain weave construction on a single phase rapier loom are 7 to 9 yards per hour. Typical weaving speeds when forming a fabric of an eight harness double-faced satin weave on a single phase rapier loom are 3 to 5 yards per hour.

Shuttle looms may be employed in the improved weaving process of the present invention. Alternatively, shuttleless looms may be selected. Representative shuttleless looms include rapier looms (either single or double phase), water-jet looms, air-jet looms, inertial looms, etc. The woven fabric will possess a normal bound selvage, a fringe selvage, etc., depending upon the specific weaving equipment selected. A particularly good loom for weaving a fabric having a 24 inch width is a Model No. A21800 rapier loom manufactured by Iwer of Spain which employs a single phase arrangement (i.e., a single rapier system). In at least some instances, it is recommended that the multifilamentary yarn bundles be lightly sprayed with water or other liquid which can readily be removed immediately prior to undergoing weaving. Alternatively, yarn humidifiers can be employed.

The unsized multifilamentary bundles may be woven in a variety of fabric configurations. For instance, the fabric may be woven in a plain weave, a satin weave, a twill weave, etc. In preferred embodiments plain weaves, five harness satin weaves, and eight harness satin weaves are formed.

Figure 8:
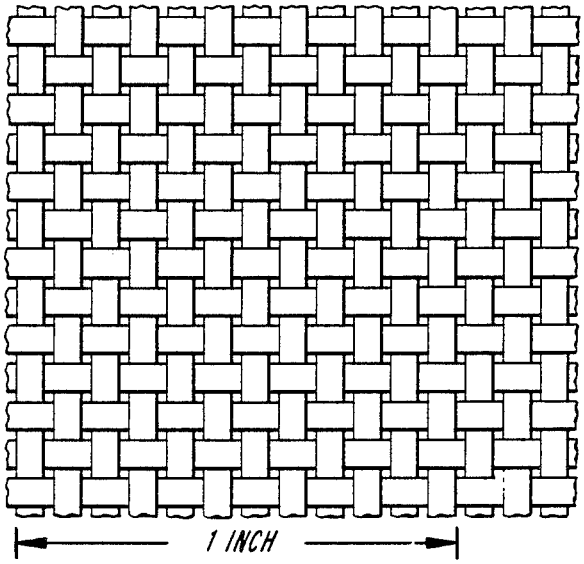

In FIG. 8 is illustrated an enlarged plan view of a portion of a representative woven fabric of the present invention which has a width of 24 inches and was formed on a single phase rapier loom wherein the weave configuration is a plain weave. Each of the warp and weft bundles illustrated consists of approximately 3,000 substantially continuous carbon filaments. The fabric consists of approximately $12\times12$ yarn bundles per inch, has a thickness of approximately 0.013 inch, and exhibits an areal weight of 190 grams/m.$^2$.

Figure 9:
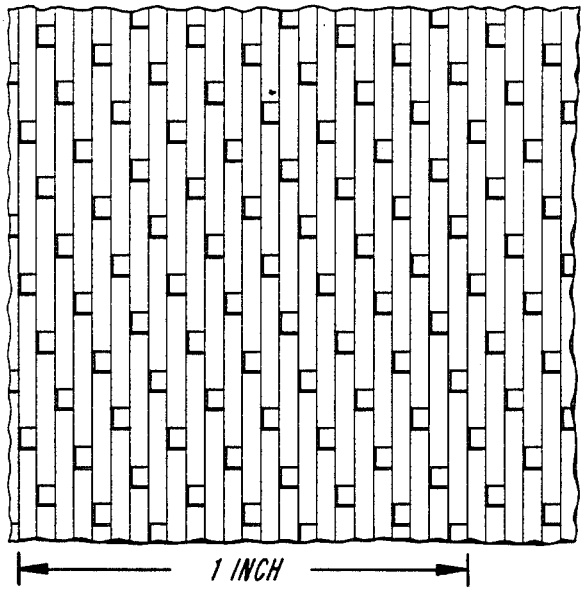

In FIG. 9 is illustrated an enlarged plan view of a portion of a representative woven fabric of the present invention which has a width of 24 inches and was formed on a single phase rapier loom wherein the weave configuration is an eight harness double-faced satin weave. Each of the warp and weft bundles illustrated consists of approximately 3,000 substantially continuous filaments. The fabric contains substantially more yarn bundles per unit area than the plain weave and consists of approximately $24\times23$ yarn bundles per inch, has a thickness of approximately 0.024 inch, and exhibits an areal weight of 374 grams/m.$^2$.

The unsized fabric of the present invention handles well, can be readily cut to the desired dimensions, and can well serve as fibrous reinforcement in a substantially void-free composite article comprising a solid resinous matrix material. One or more layers of the woven fabric can be used as fibrous reinforcement in a composite article. In a preferred embodiment, a plurality of layers of the woven fabric can be stacked within the matrix of the composite article. In some instances a $\pm90$ degree orientation of the layers of woven fabric in the composite article is preferred. If more balanced mechanical properties are desired in the composite article, at least some of the woven fabric sheets are rotated 45 degrees with respect to the others.

Representative thermoset resins which can serve as the matrix material in such composite articles include epoxy resins, polyimide resins, bismaleimide resins, vinylester resins, unsaturated polyester resins, etc., and mixtures of the foregoing.

Representative thermoplastic resins which can serve as the matrix material in such composite articles include polyetherketone resins, polyphenylenesulfide resins, polysulfone resins, saturated polyester resins (e.g., polyethylene terephthalate and polybutylene terephthalate), polyamide resins, polyamideimide resins, polyetherimide resins, etc., and mixtures of the foregoing.

The unsized fiber bundles suitable for weaving in accordance with the present invention can be formed as described in the following Examples with the exception that no protective size is applied to carbon fiber bundles following their formation and surface treatment.

The following Examples are given as specific illustrations in the present invention. It should be understood, however, that the invention is not limited to the specific details set forth in the Examples.

EXAMPLE I

An acrylonitrile copolymer multifilamentary tow consisting of approximately 3,000 substantially parallel substantially continuous filaments consisting of approximately 98 mole percent of acrylonitrile units and approximately 2 mole percent of methylacrylate units was selected as the starting material. The multifilamentary tow following spinning was drawn to increase its orientation and possessed a total denier of approximately 2,700 and a denier per filament of approximately 0.9.

The multifilamentary tow of acrylonitrile copolymer was thermally stabilized by passing in the direction of its length through heated circulating air ovens. The multifilamentary tow was substantially suspended in the circulating air ovens when undergoing thermal stabilization and was directed along its course by a plurality of rollers. While present in such circulating air ovens, the multifilamentary tow was heated in the range of 220 to 290° C. for approximately one hour. The resulting thermally stabilized acrylonitrile copolymer tow when it emerged from the circulating air ovens was totally black in appearance, and was non-burning when subjected to an ordinary match flame. The tow possessed a total denier of approximately 3,600 and a denier per filament of approximately 1.2. It was observed that the individual filaments of thermally stabilized multifilamentary tow were well aligned and collimated in a substantially uniform manner.

The thermally stabilized acrylonitrile copolymer tow next was passed in the direction of its length through the horizontal cylindrical bore of a device which is directly analogous to that illustrated in FIG. 1 of U.S. Pat. No. 3,727,274 wherein three streams of water struck the multifilamentary tow and the substantially parallel relationship of the filaments was disrupted in the substantial absence of filament damage. The cylindrical bore of the device through which the tow was passed possessed a length of 0.5 inch and a diameter of 0.141 inch. On one side of the cylinder two substantially parallel streams emerged having a diameter of 0.047 inch which were substantially tangential to the bore of the cylinder, and on the opposite side one stream emerged having a diameter of 0.047 inch which was positioned radially to the bore of the cylinder and with all of the outlets being in a common plane which was substantially perpendicular (i.e., at 90 degrees) to the multifilamentary fibrous material and to the cylinder. The device was completely submerged in water. Water was supplied to the three streams at a total flow rate of 0.9 gallon/minute. The thermally stabilized acrylonitrile copolymer was passed through pairs of nip rolls before and after it passed through the device wherein the parallel relationship of the filaments was disrupted and the tow was provided therein while under a longitudinal tension of 300 grams (i.e., under a longitudinal tension of 0.08 gram per denier).

The resulting thermally stabilized multifilamentary tow of decollimated acrylic filaments was next dried by passing in the direction of its length through a circulating air oven.

This dried multifilamentary tow was next carbonized by passage in the direction of its length through a furnace provided at a temperature greater than 1200° C. containing a flowing nitrogen atmosphere. The resulting carbonaceous fibrous material had a tensile stength of approximately 540,000 psi, was untwisted, contained approximately 95 percent carbon by weight, and substantially retained the decollimation previously imparted. This product was subjected to an oxidative surface treatment to improve its adhesion to a matrix resin, was coated with a epoxy sizing composition, and was capable of being readily impregnated by and dispersed within a matrix-forming resin to form a quality composite article.

Figure 2:
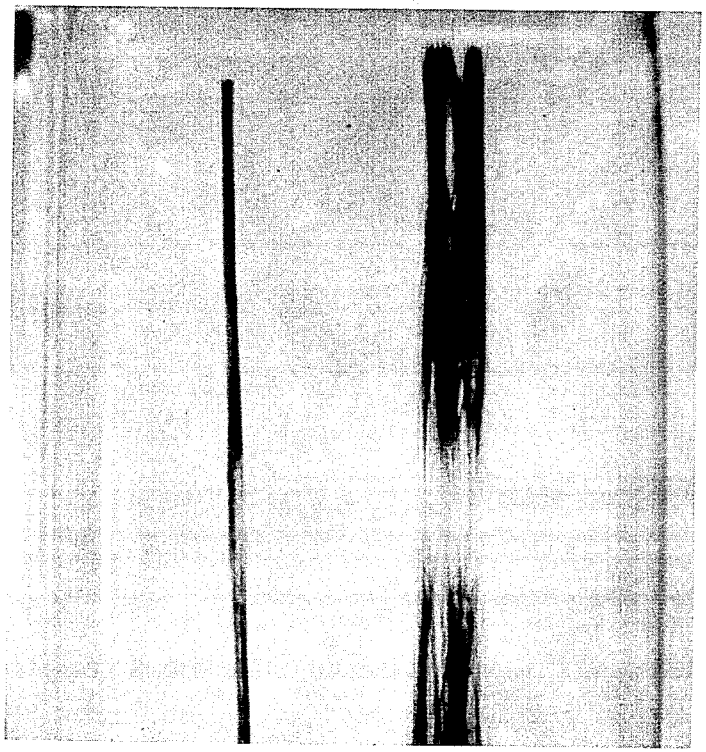

The multifilamentary product of Example I had a generally flattened configuration and an average width of approximately 0.13 cm. prior to being subjected to the flaring test heretofore described in acetone. FIG. 2 on left shows a segment of the multifilamentary tow at the conclusion of the flaring test. It then had an average width of approximately 0.18 cm. and had expanded externally only approximately 1.4 times as the result of the commingling of adjacent filaments.

For comparative purposes Example I was substantially repeated with the exception that the thermally stabilized acrylonitrile copolymer tow was not passed through the water jets prior to carbonization. The resulting multifilamentary tow had a width of approximately 0.18 cm. and is shown at the left of FIG. 1 with enlargement. FIG. 2 on the right shows a segment of the multifilamentary tow at the conclusion of the flaring test. It then had an average width of approximately 1.5 cm. and had expanded laterally approximately 8.3 times its original width.

EXAMPLE II

Example I was substantially repeated with the exceptions indicated. The cylindrical bore of the device through which the tow was passed possessed a diameter of 0.120 inch and the jets through which the water streams emerged each had a diameter of 0.040 inch. The water was supplied to the three streams at a total flow rate of 0.8 gallon/minute. The resulting carbonaceous fibrous material had a tensile strength of approximately 576,000 psi.

A segment of the generally flattened multifilamentary product of Example II is shown at the right of FIG. 1 with enlargement. It had an average width of approximately 0.13 cm. prior to subjection to the flaring test. As shown in left of FIG. 3 following subjection to the flaring test it had an average width of approximately 0.18 cm. and had expanded laterally only approximately 1.4 times as a result of the commingling of adjacent filaments.

Figure 3:
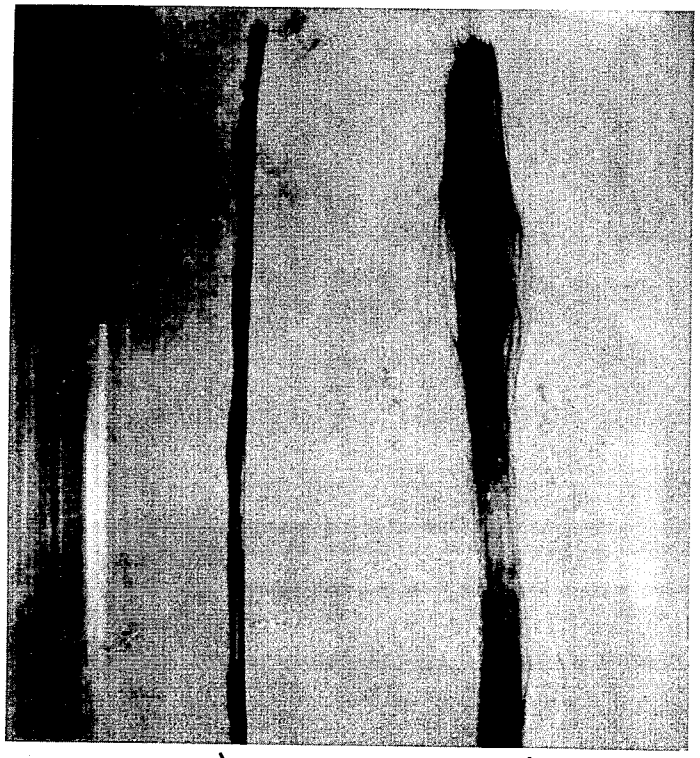

For comparative purposes a segment of an approximately 3,000 filament tow of carbonaceous fibrous material which is marketed by the Union Carbide Corporation under the THORNEL 300 designation was subjected to the flaring test described herein in acetone. Prior to subjection to the flaring test it had an average width of approximately 0.15 cm. FIG. 3 on the right shows a segment of the multifilamentary tow at the conclusion of the flaring test. It then had an average width of approximately 1.3 cm. and had expanded laterally approximately 8.7 times.

Figure 4:
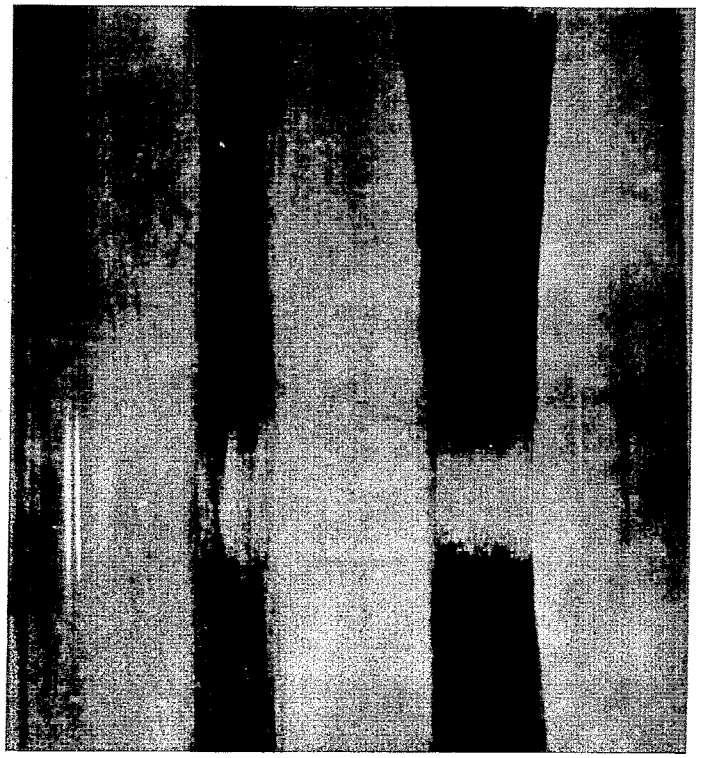

For comparative purposes a segment of an approximately 3,000 filament tow of carbonaceous fibrous material which is marketed by Hercules Incorporated under the AS4-W designation was subjected to the flaring test described herein in methylene chloride. Prior to subjection to the flaring test it had an average width of approximately 0.13 cm. FIG. 4 on the left shows a segment of the multifilamentary tow at the conclusion of the flaring test. It then had an average width of approximately 1.5 cm. and had expanded laterally 11.5 times.

EXAMPLE III

Example I was substantially repeated with the exceptions indicated. The acrylonitrile copolymer multifilamentary tow consisted of approximately 12,000 substantially parallel substantially continuous filaments. It possessed a total denier of approximately 10,800 and a denier per filament of approximately 0.9. Following thermal stabilization the multifilamentary tow possessed a total denier of approximately 14,400 and a denier per filament of approximately 1.2. The cylindrical bore of the device through which the tow was passed possessed a diameter of 0.157 inch and the jets through which the water streams emerged each had a diameter of 0.052 inch. The water was supplied to the three streams at a total flow rate of 1.35 gallon/minute and the tow was under a longitudinal tension of approximately 500 grams (i.e., under a longitudinal tension of approximately 0.07 gram per denier). The resulting carbonaceous fibrous material had a tensile strength of approximately 594,000 psi. The multifilamentary tow had an average width of approximately 0.25 cm. prior to subjection to the flaring test described herein. As shown on the left of FIG. 5, the multifilamentary tow when subjected to the flaring test exhibited an average width of approximately 0.33 cm. and had expanded laterally only approximately 1.3 times as the result of the commingling of adjoining filaments.

EXAMPLE IV

Example III was substantially repeated with the exceptions indicated. The water was supplied to the three streams at a total flow rate of 1.50 gallon/minute. The resulting carbonaceous fibrous material had a tensile strength of approximately 552,000 psi.

Figure 6:
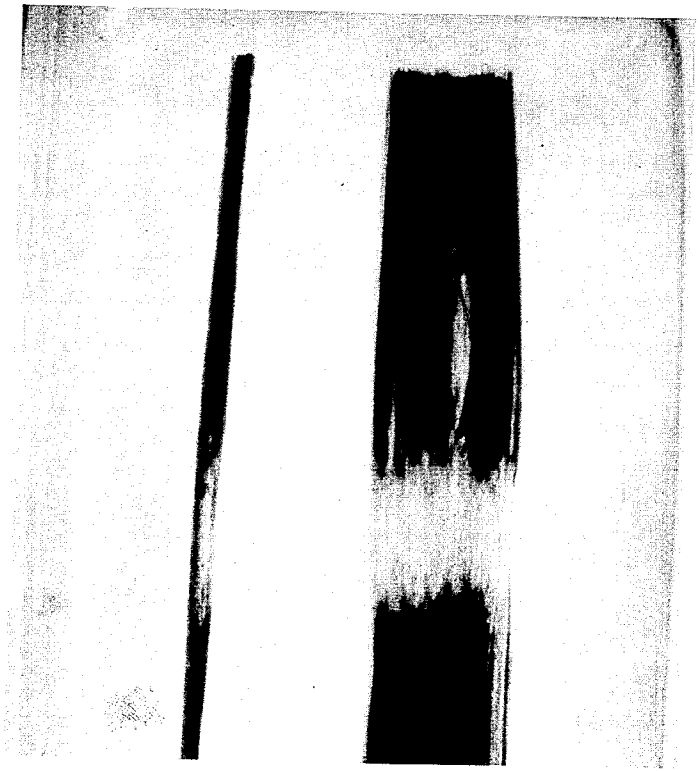

The multifilamentary product of Example IV had a generally flattened configuration and an average width of approximately 0.4 cm. prior to subjection to the flaring test described herein in acetone. FIG. 6 on the left shows a segment of the multifilamentary tow at the conclusion of the flaring test. It then had an average width of approximately 0.4 cm. and had not expanded laterally to any measurable degree as the result of the commingling of adjacent filaments.

For comparative purposes Example IV was substantially repeated with the exception that the thermally stabilized acrylonitrile copolymer tow was not passed through the water jets prior to carbonization. The resulting filamentary tow had a width of approximately 0.4 cm. prior to subjection to the flaring test described herein in acetone. FIG. 6 on the right shows a segment of the multifilamentary tow to the conclusion of the flaring test. It then had an average width of approximately 3.3 cm and had expanded laterally approximately 8.3 times its original width.

For comparative purposes a segment of an approximately 12,000 filament tow of carbonaceous fibrous material which is marketed by Hercules Incorporated under the designation AS4-W was subjected to the flaring test decribed herein in methylene chloride. Prior to subjection to the flaring test it had an average width of approximately 0.3 cm. FIG. 4 on the right shows a segment of the multifilamentary tow at the conclusion of the flaring test. It then had an average width of approximately 2.3 cm. and had laterally expanded approximately 7.7 times.

Figure 5:
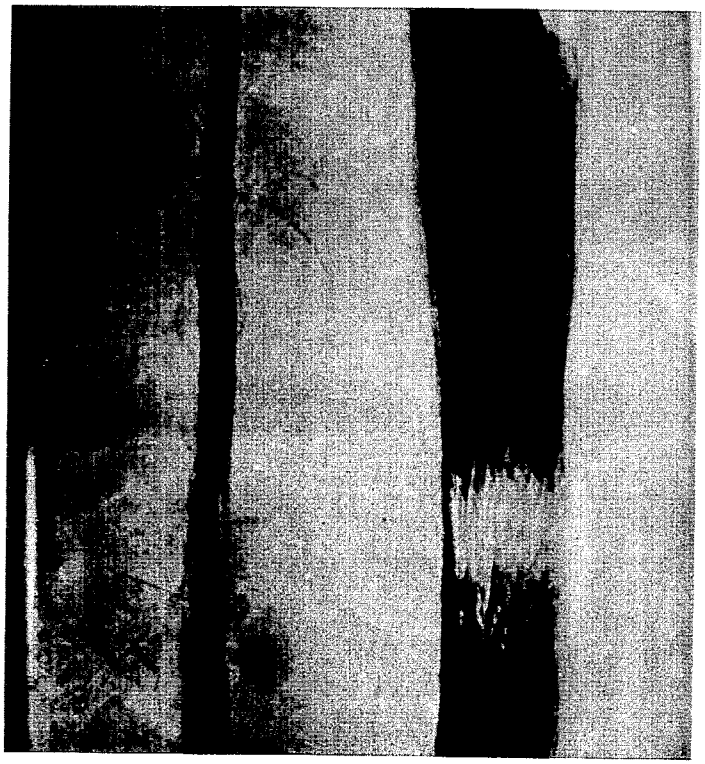
Figure 7:
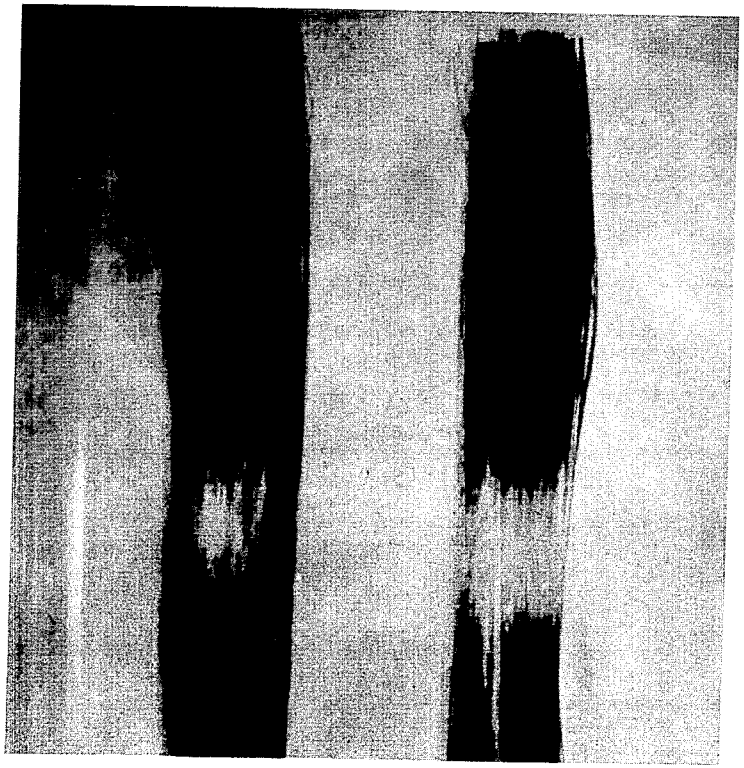

For comparative purposes a segment of an approximately 12,000 filament tow of carbonaceous fibrous material which is marketed by Hercules Incorporated under the designation AS2-G was subjected to the flaring test described herein in acetone. Prior to subjection to the flaring test it had an average width of 0.33 cm. FIG. 5 on the right shows a segment of the multifilamentary tow at to the flaring test it had an average width of approximately 0.4 cm. FIG. 7 on the left shows a segment of the multifilamentary tow at the conclusion of the flaring test. It then had an average width of approximately 2.5 cm. and had laterally expanded approximately 6.3 times.

For comparative purposes a segment of an approximately 12,000 filament tow of carbonaceous fibrous material which is marketed by the Union Carbide Corporation under the THORNEL 300 designation was subjected to the flaring test described herein in acetone. Prior to subjection to the flaring test it had an average width of approximately 0.46 cm. FIG. 7 on the right shows a segment of the multifilamentary tow at the conclusion of the flaring test. It then had an average width of approximately 2.54 cm. and had laterally expanded approximately 5.5 times.

Although the invention has been described with preferred embodiments, it is to be understood that variations and modifications may be resorted to as will be apparent to those skilled in the art. Such variations and modifications are to be considered within the purview and scope of the claims appended hereto.

We claim:

1. In a process for weaving a fabric suitable for use as fibrous reinforcement in a resinous matrix material wherein the fabric incorporates a plurality of multifilamentary yarn bundles comprising adjacent substantially continuous carbonaceous filaments containing at least 70 percent carbon by weight; the improvement comprising supplying said multifilamentary yarn bundles during said weaving in an unsized form wherein the individual filaments of said multifilamentary yarn bundles are randomly decollimated and commingled with numerous filament cross-over points throughout their lengths so as to create a multitude of interstices between adjacent filaments which are well adapted to receive and retain a matrix-formings resin as evidenced by an ability of the filaments of said yarn bundles when subjected to the flaring test described herein while in a substantially untwisted state to resist lateral expansion to a width which is as much as one and one-half times the original width as a result of said commingling of adjacent filaments.

2. An improved weaving process according to claim 1 wherein said multifilamentary yarn bundles are formed from approximately 1000 to 50,000 substantially continuous filaments.

3. An improved weaving process according to claim 1 wherein said multifilamentary yarn bundles are formed from approximately 3,000 to 12,000 substantially continuous filaments.

4. An improved weaving process according to claim 1 wherein said substantially continuous carbonaceous filaments contain at least 90 percent carbon by weight.

5. An improved weaving process according to claim 1 wherein said substantially continuous carbonaceous filaments were derived from acrylic filaments.

6. An improved weaving process according to claim 1 wherein said multifilamentary yarn bundles following weaving exhibit at least 90 percent of the tensile strength exhibited immediately prior to weaving.

7. An improved weaving process according to claim 1 wherein said multifilamentary yarn bundles have a tensile strength of at least 400,000 psi before and after weaving.

8. An improved weaving process according to claim 1 wherein said multifilamentary yarn bundles have a tensile strength of at least 450,000 psi before and after weaving.

9. An improved weaving process according to claim 1 wherein said multifilamentary yarn bundles have a tensile strength of at least 500,000 psi before and after weaving.

10. An improved weaving process according to claim 1 wherein said multifilamentary bundles have a tensile strength of at least 700,000 psi before and after weaving.

11. An improved weaving process according to claim 1 wherein said multifilamentary yarn bundles are substantially free of a twist when woven.

12. An improved weaving process according to claim 1 wherein said multifilamentary yarn bundles possess a twist of approximately 0.1 to 1.0 turns per inch when woven.

13. An improved weaving process according to claim 1 wherein said carbonaceous filaments have a denier per filament of approximately 0.2 to 1.5.

14. An improved weaving process according to claim 1 wherein said carbonaceous filaments have a denier per filament of approximately 0.3.

15. An improved weaving process according to claim 1 wherein said carbonaceous filaments have a denier per filament of approximately 0.6.

16. An improved weaving process according to claim 1 wherein said multifilamentary yarn bundles when subjected to the flaring test described herein while in a substantially untwisted state resist lateral expansion to a width which is as much as one and one-fourth times the original width as a result of said commingling of adjacent filaments.

17. An improved weaving process according to claim 1 wherein said multifilamentary yarn bundles when subjected to the flaring test described herein while in a substantially untwisted state retain substantially the same width as that originally exhibited as a result of said commingling of adjacent filaments.

18. An improved weaving process according to claim 1 wherein said multifilamentary yarn bundles are woven to form a fabric having a plain weave configuration.

19. An improved weaving process according to claim 1 wherein said multifilamentary yarn bundles are woven to form a fabric having a satin weave configuration.

20. An improved weaving process according to claim 1 wherein said multifilamentary yarn bundles are woven by use of a shuttleless loom to form said fabric.

21. An improved weaving process according to claim 20 wherein said multifilamentary yarn bundles are woven by use of a rapier loom to form said fabric.

22. An improved weaving process according to claim 1 wherein said multifilamentary yarn bundles are woven by use of a shuttle loom.

* * * * *